United States Patent [19]

Peterson

[11] 4,307,591

[45] Dec. 29, 1981

[54] ROLLING MILL LOOPER CONTROL SYSTEM

[75] Inventor: Robert S. Peterson, Amherst, N.Y.

[73] Assignee: Westinghouse Electric Corp., Pittsburgh, Pa.

[21] Appl. No.: 135,748

[22] Filed: Mar. 31, 1980

[51] Int. Cl.[3] ..... B21B 37/06; B65H 25/00

[52] U.S. Cl. ..... 72/17; 72/205; 226/25

[58] Field of Search ..... 72/17, 19, 8, 10, 11, 72/21, 205; 226/25, 42, 44, 114

[56] References Cited

U.S. PATENT DOCUMENTS

| | | | |
|---|---|---|---|
| 2,192,044 | 2/1940 | Lessmann | 72/205 |
| 2,363,684 | 11/1944 | Montgomery | 72/8 |
| 3,169,422 | 2/1965 | Sims et al. | 72/205 |
| 3,237,439 | 3/1966 | Torrance | 72/205 |
| 3,332,263 | 7/1967 | Beadle et al. | 72/7 |
| 3,399,556 | 9/1968 | Bensema et al. | 72/21 |
| 3,848,443 | 11/1974 | Peterson | 72/205 X |
| 4,033,492 | 7/1977 | Imai | 72/205 X |
| 4,162,624 | 7/1979 | Morooka et al. | 72/8 |

FOREIGN PATENT DOCUMENTS

| | | | |
|---|---|---|---|
| 662177 | 5/1979 | U.S.S.R. | 72/205 |

*Primary Examiner*—Milton S. Mehr
*Attorney, Agent, or Firm*—C. M. Lorin

[57] ABSTRACT

In a hot strip rolling mill a velocity damping compensator circuit is added to the current regulating loop of the looper motor drive generating a torque on the looper arm mechanism between roll stands, thereby to prevent disturbances when applying the looper arm and looper roller against the strip being rolled.

2 Claims, 6 Drawing Figures

ROLLING MILL LOOPER CONTROL SYSTEM

BACKGROUND OF THE INVENTION

The invention relates in general to interstand tension control apparatus for a rolling mill, and more particularly to looper control apparatus in a tandem or continuous hot strip rolling mill.

The looper is a mechanism installed between any two stands, in a tandem mill installation. This mechanism provides for a desired tension on the strip as it is fed and being processed through the mill.

Although there are several loopers on a multistand tandem hot strip mill, actually one looper between each stand, the description hereinafter will refer to a single looper to illustrate any one of the loopers located between any two stands. The stand at which the strip initially enters before reaching the looper arm will be referred to as the entry stand and the stand after the looper arm will be referred to as the exit stand. The looper table projects an arm carrying a roller across the pass line between stands and it maintains under the torque of the looper motor an adequate tension on the strip once the looper roller has engaged the strip and formed the loop. Initially, the looper arm and roller are in the rest position below the pass line. The looper table is actuated as soon as the strip from the entry stand has reached and passed through the exit stand, past the looper table. In order to extend the looper arm swiftly across the pass line, the looper drive motor is so energized as to generate a looper "motor current spike" causing an "auto raise kick" of the looper mechanism.

The final position of the roller, or "height" of the looper, in operation is defined by the inclination angle of the looper arm. It depends upon the size of the loop derived from the entry stand. The interstand tension is maintained constant by the torque of the looper drive motor applied to the arm and looper roller. Such torque is controlled for a given "height", or set point, and in accordance with the corresponding loop length.

More specifically, the height of the looper table roller is regulated to a set point by a looper position regulator actuated when the strip enters the exit stand. This regulation is accomplished by the looper position regulator through control of the speed of either the entry stand or the exit stand, thereby adjusting the loop length to the looper height, e.g., the looper table angle. On the other hand, the looper drive motor torque is programmed to vary as a function of the looper height, e.g., looper table angle, so as to maintain the strip tension constant. Regulation of the looper motor drive torque is by control of the looper drive motor current.

A problem arises, however, which is due to the simultaneous operations of these two types of control. Variations of the looper motor torque build-up as the looper height varies and an unmatched anticipated height under the "auto raise kick" from the looper motor current spike, may result in hunting.

A variation in looper motor torque causes a fluctuation in the force being applied to the strip where the looper arm rollers make contact with the strip. This strip force variation is a disturbance to the looper position regulator which is trying to maintain a preset strip loop height. If the strip force disturbance causes looper oscillations, this can cause a change in the tension of the strip which, in turn, causes the strip to be rolled off-gauge, and also there can be a strip width reduction called "strip necking". Looper oscillations may also be damaging to the mill installation if the strip would move off-center and leave the stand rolls towards the mill housing after jumping out of the strip guides.

One attempt of preventing this from occurring has been to remove the "auto raise kick" feature, that is the initial looper motor current spike, and to operate without torque adjustment to the table angle, e.g., the looper height. Thus, the system would operate at constant motor torque. Unfortunately, this is not an acceptable practice because at low looper height too much tension is exerted upon the strip, or loop, whereas at high looper operating height, not enough tension is applied to the strip to keep a tight strip between the stands. It appears that regulation of the looper torque as a function of the looper height cannot be dispensed with if a tight strip is to be maintained during looper transients.

In the absence of the "auto raise kick" feature, the looper roll is too slow to raise itself and make contact with the strip following energization of the looper regulator. It is important that the strip loop be formed as soon as possible if delivery strip gauge and width is not to vary from the set point.

SUMMARY OF THE INVENTION

An object of the present invention is to improve the operation of a roll mill looped system combining a looper height responsive looper motor current controller and a looper position regulator.

The present invention resides in the provision of a velocity damping circuit associated with the looper motor current controller for reducing looper oscillations caused by the looper position regulator.

DETAILED DESCRIPTION OF THE INVENTION

Figure 1:
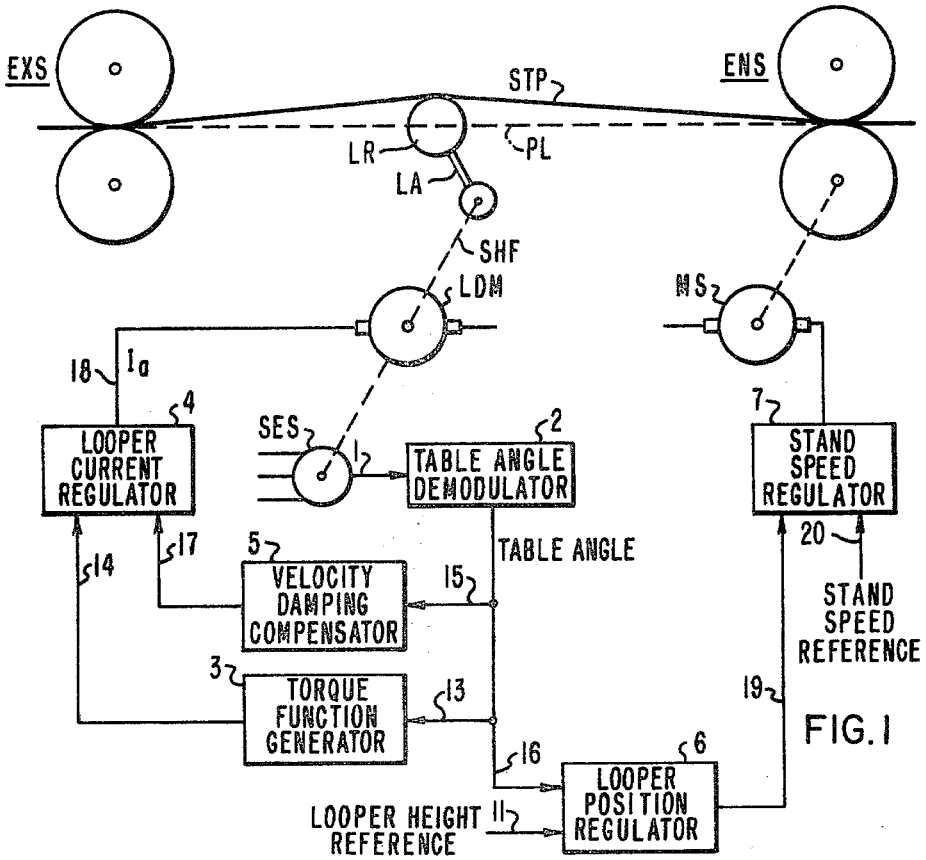
FIG. 1 is a simplified block diagram of the loop control system according to the invention.

Referring to FIG. 1 a looper installation is shown between an entry stand ENS and an exit stand EXS of a hot strip rolling mill. A strip of metal STP rolled by roll stands such as ENS and EXS is raised, above the pass line PL shown in dotted line, by a looper position regulator which changes the entry stand speed to maintain a given strip storage. The strip storage between the stands is measured by the height of a looper roller LR at the extremity of a looper arm LA which is mounted on the shaft SHF of a DC current looper drive motor LDM. On the shaft is also mounted a selsyn SES which is used to resolve in terms of inclination angles the angular position of the looper arm under the torque exerted by the motor LDM against the strip STP. The looper angle is then used as an indication of looper table height which is regulated to a preset value by the looper position regulator.

Angular rotation of the shaft of looper drive motor LDM is converted by selsyn SES into a signal and representing the instantaneous angle $\theta$ of rotation. Such angular positioning is also the angular position of arm LA of the looper, and therefore the height of the looper roller LR above the pass line. The output signal from selsyn SES is applied via line 1 into a table angle demodulator 2 which provides a signal output measuring the radians. Such radian signal on line 13 is converted by a torque function generator 3 into a feedback signal representing torques as exerted by motor LDM upon the strip in relation to angular position $\theta$. The looper current regulator 4 is responsive to the output on line 14 from the torque function generator, and it controls the armature current supplied to the rotor of the motor. The current regulator generally includes semiconductor controlled rectifiers having their firing angle controlled as a function of a feedback signal in relation to a reference signal for establishing a desired torque. Secondly, the table angle signal from circuit 2 is also fed into a velocity damping circuit 5 which, according to the present invention, provides at its output on line 17 a signal which is the derivative of the angular position signal $\theta$. Looper current regulator is responsive to the signal from line 17. Thirdly, the table angle signal from circuit 2 is fed into a looper position regulator 6 which is also responsive to a reference signal on line 11 characterizing the height set point of the looper roller LR. Accordingly, the looper position regulator 6 provides via line 19 a stand speed reference signal to the stand speed regulator 7 of motor drive MS of the entry roller stand ENS. Circuit 7 is otherwise responsive to a reference signal establishing a desired stand speed for the rolls of stand ENS since, for normal mass flow and gauge conditions between stands ENS and EXS, there is a predetermined relative speed between the rolls of stands ENS and EXS.

The looper position regulator 6 establishes as a function of the reference signal of line 11 a desired height for the loop roller LR, which is achieved by accelerating the speed of motor MS relative to the speed assigned by stand speed regulator 7 under the reference signal of line 20. As a result, the length of strip STP is increased so as to form a "loop" above the pass line which is to be in relation to the intended height of roller LR, e.g., the one assigned by the reference of line 11.

However, as explained hereinbefore, rapid changes in the torque generated via line 14 and looper current regulator 4 in conjunction with the dynamics of looper position regulator 6 can cause looper arm oscillations. The velocity damping circuit 5, by reacting to such oscillatory values of the table angle on line 15, will in fact neutralize such effect, by preventing the looper motor torque from changing rapidly under a rapid change in the looper arm height. Therefore, in conjunction with the looper motor current regulator, the looper position regulator 6 will be able to establish the desired height, without oscillations.

Figure 2:
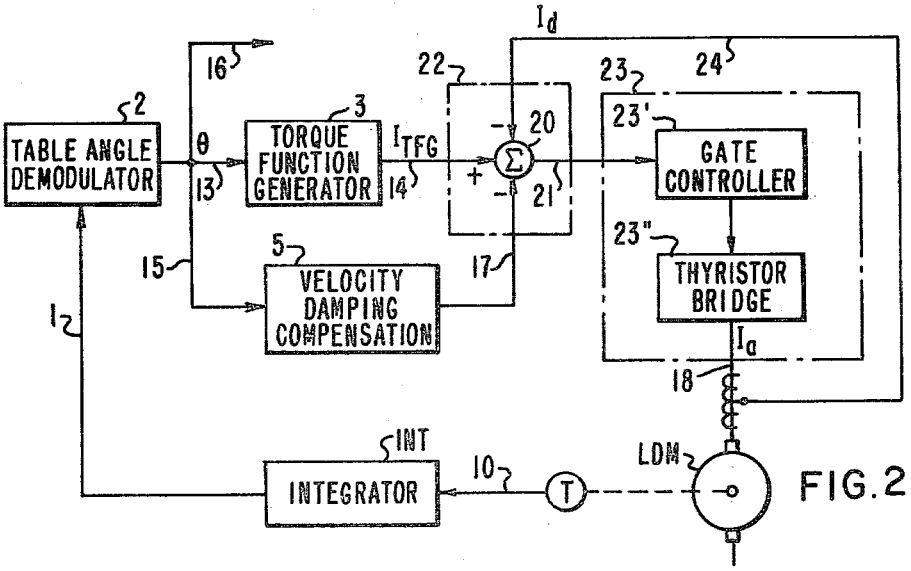
FIG. 2 is specific to the looper table drive motor current controller which is part of the system of FIG. 1.

Referring to FIG. 2, the insertion in circuit of the velocity damping circuit 5 is shown in more detail, and in association with the looper current regulator 4 shown to include, as conventionally known, a current controller and static controlled converter system 23 for outputting on line 28 an armature current $I_a$ of controlled magnitude. For the sake of clarity, the derivation of the table angle signal on line 1 is shown derived through a tachometer T, and an integrator INT, rather than with a selsyn. The output on line 14 from the torque function generator 3 is applied inside current controller 22 to a summer 20 as a positive signal, and the output on line 17 from the velocity damping compensator 5 is applied as a negative signal to summer 20. An armature current feedback signal $I_d$ is also applied by line 24 to summer 20, to be subtracted from the actual torque representative signal $I_{TFG}$ of line 14. The signal outputted on line 21 by summer 20 goes to a circuit including a thyristor pulse gate generator 23' within the static controlled converter system 23, which gate generator determines the firing angle of a circuit including a thyristor bridge 23'' which in turn establishes the armature current $I_a$ on line 18 for motor LDM, thus, the torque for the looper arm and roller.

Figure 3:
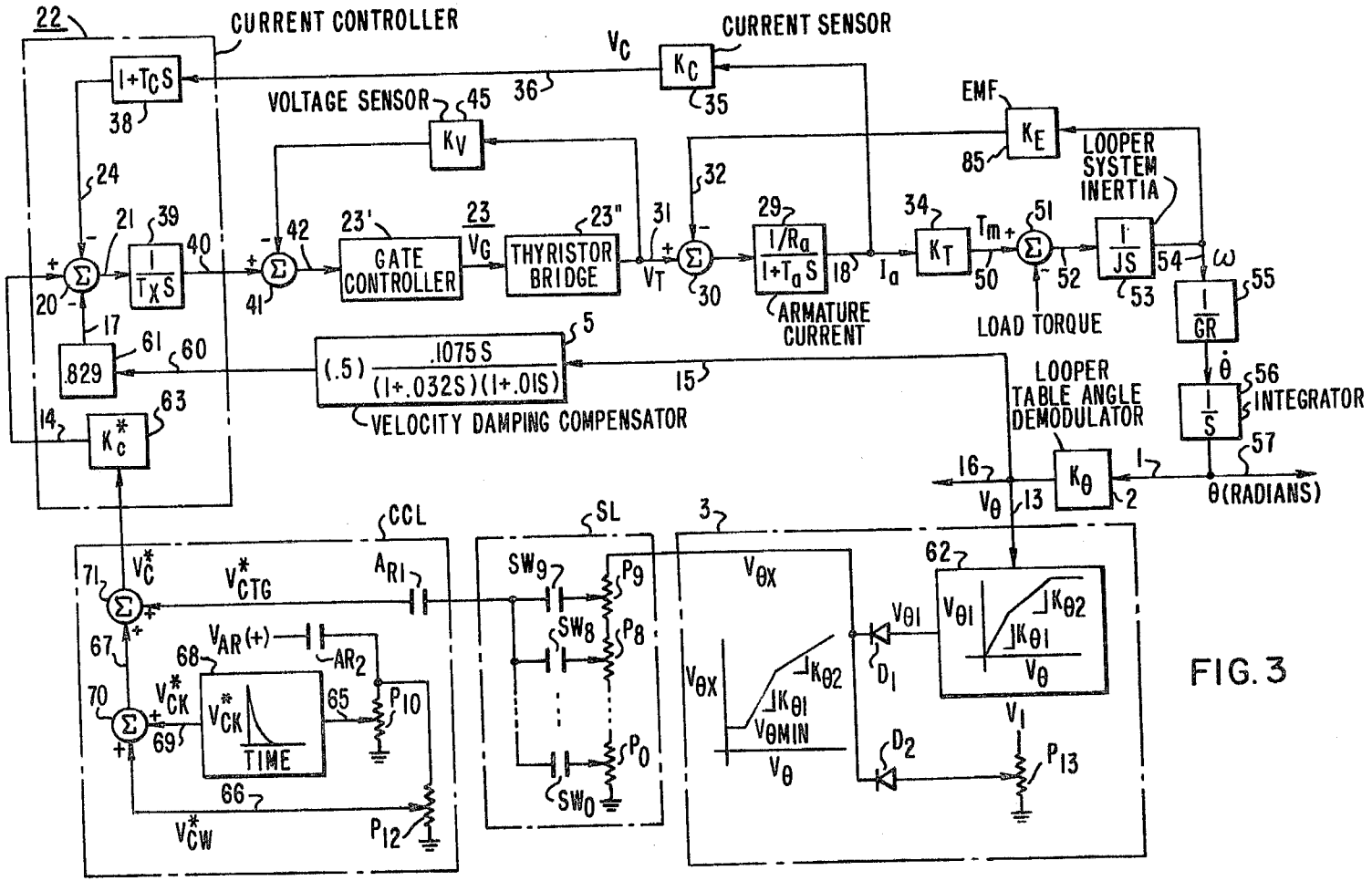
FIG. 3 is a more detailed block diagram of the looper table drive motor current controller of FIG. 2 in the preferred embodiment.

Referring to FIG. 3, the looper current regulator 4, torque function generator 3 and velocity damping compensator 5 of FIG. 1 are shown in more detail, and in functional diagram fashion.

Block 29 represents within circuit 23'' the transfer function between armature current and the current controlling signals 31, 32 summed up by a summer 30. The transfer function of block 29 is:

$$\frac{1/R_a}{1 + T_a S}$$

where $T_a$ is a time constant, S the Laplace operator and $R_a$ the armature resistance.

Summer 30 is responsive to the firing angle control signal $V_g$ from the gate controller 23' which within circuit 23'' is converted into motor terminal voltage $V_T$ establishing an armature current flow level $I_a$ after transformation by block 29. A signal on line 32 represents the motor back e.m.f. to the summer 30. Typically, the looper drive motor LDM is rated for 380 amperes. The armature current $I_a$ of line 18 is sensed and a signal representative of $I_a$ is derived on line 33 which is fed back with a reaction factor $K_C$ as shown by block 35, thus providing a control signal $V_C$ on line 36 to the current controller 22. Signal $V_C$ is, however, first converted by the transfer function $(1+T_C S)$ of function generator 38 within the current controller 22, before outputting the feedback signal of line 24 to summer 20 of FIG. 2. The output of summer 20, on line 21, is fed into a function generator 39, also within current controller 22.

From current controller 22, like in FIG. 2, the control signal, on line 40, goes to the thyristor gate controller of circuit 23'. The gate pulse from generator controller 23' controls the firing angle of the thyristor bridge TPS of circuit 23'', thereby outputting for the motor on armature terminal voltage symbolized by signal $V_T$ of line 31 into summer 30.

The armature current $I_a$ of line 33 results from the transfer function of block 29 in response to summer 30. The armature current is converted into a torque signal $T_m$ appearing on line 50 and effective on the shaft of the motor. The torque signal $T_m$ is sensed as a function of the armature $I_a$ and appears on line 50 after a coefficient of proportionality $K_T$ shown by block 34.

Summer 51 sums up the signal of line 50 with a feedback signal of line 82 (1/J) representing the load on the shaft, e.g., looper roller and strip tension. The resulting signal from summer 51 is converted by the looper system inertia as illustrated by function generator 53 of transfer function 1/JS, where J is the moment of inertia of the system, thereby yielding a signal characteristic of motor speed $\omega$, on line 54. This speed signal through function generator 85, introducing a constant $K_E$, provides the inherent motor back e.m.f. feedback signal of line 32 to summer 30. The looper table angle demodulator 2 of FIG. 1 is responsive to the speed signal of line 54, after it has been converted into degrees by function 1/GR of block 55, which in turn goes through an integrator INT by block 56 (function 1/S). The derived radian signal of line 57 is converted into the signal of lines 15 and 13 by the looper table angle demodulator 2 introducing a proportionality factor $K_\theta$.

FIG. 3 shows also in detail the two control loops of FIG. 1 including the torque function generator 3 via line 13 and the velocity damping compensator 5 via line 15, respectively.

The velocity damping compensator is a function generator inserting the transfer function:

$$T_3S/(1+T_1S)(1+T_2S)$$

where S is the Laplace operator, $T_1$ and $T_2$ are selected time delays and $T_3$ is a lead time constant (rate).

The output signal on line 60 leads to the differentiating signal of line 17 into summer 20, after passing through another function generator 61 of selected coefficient of proportionality.

As shown in FIG. 3, the time constants have been selected to be $T_1=0.032$, $T_2=0.01$, and $T_3=0.1075/0.5$.

Considering torque function generator 3, block 62 shows by a curve the function $V_{\theta 1}$ of $V_\theta$ as a broken line defined by two segments of a line having slopes $K\theta_1$ and $K\theta_2$. A potentiometer $P_{13}$ provides a bias which through diode $D_2$ is combined with the output through diode $D_1$ from block 62. This results into the same function as in block 62 but shifted to an initial bias instead of the origin.

The output from torque function generator 3 is passed through a selector SL including ten selectable switches $SW_0$–$SW_9$ for selecting one or more of ten potentiometers $P_0$–$P_9$. Selector SL permits to choose one of ten levels in relation to the outputted signal generated by torque function generator 3.

The output $V^*_{CTG}$ from selector SL goes through normally open contacts $AR_1$ of a start-up relay AR to provide through summer 71 a signal $V^*_C$. After block 63 introduces a constant of proportionality $K^*_C$, the signal becomes the signal of line 14 to the current controller. Signal $V^*_{CTG}$ is a reference signal defining a certain torque for motor LDM, thus, a certain height for looper roller LR, e.g., a certain tension on the strip STP.

However, as shown in FIG. 3, reference signal $V^*_C$ is the output of summer 71, thus is modified by a signal on line 67 in current command limiter circuit CCL. From a potential source $V_{AR}$ via open contacts $AR_2$ of relay AR and two potentiometers $P_{10}$ and $P_{12}$ signals are derived on respective lines 65 and 66. The signal from line 65 is converted by function generator 68 into a peak-shaped signal so that potentiometer $P_{10}$ introduces on line 69 a strong signal of peak value $V^*_{CK}$ which is in the form of a strong pulse intended to generate the motor current spike for the "auto raise kick". Potentiometer $P_{12}$ introduces on line 66 a bias signal $V^*_{CW}$ which is added by summer 70 to the pulse signal $V^*_{CK}$ of line 69. Signal $V^*_{CW}$ compensates for looper table weight. The output of summer 70 is on line 67 the effective auto-raise kick voltage referred to earlier in relation to FIGS. 1 and 2. A relay AR (not shown) when actuated closes contacts $AR_1$ and $AR_2$. Contacts $AR_2$ apply the potential source $V_{AR}$ to potentiometers $P_{10}$ and $P_{12}$. Contacts $AR_1$ apply to summer 71 the tension reference signal $V^*_{CTG}$. Thus, when the "auto-raise kick" is called for, a forced current reference signal of short duration is applied by line 67 to summer 71.

The "auto-raise kick" is a very short signal pulse as shown in function generator block 68. The pulse dies out after approximately 0.5 seconds, thus, providing only an initial torque "kick" to move the looper table arm LA up to make contact with the strip STP. At the same time, contacts $AR_1$ are closed permitting torque function generator 3 to provide the required current reference to the looper current regulator to maintain a constant strip tension regardless of looper operating height.

The symbols used in FIG. 3 are as follows:

GR=Gear ratio between looper shaft and motor shaft, decimal

J=Total looper inertia at motor shaft, slug×ft.$^2$ $$J = \frac{\overset{\text{Mech.}}{70} + \overset{\text{Mtr.}}{135}}{32.2} = 6.304 \text{ slug.} \times \text{ft.}^2$$

$K_T$=Looper motor torque constant ($K_T$=2.97); Lb-Ft/ampere $K_E$=Looper motor voltage constant, volts/(radian/-sec.)

$R_a$=Looper motor armature resistance, ohms $T_a$=Looper motor armature time constant, sec.

$I_a$=Looper motor arm current, amperes $T_m$=Looper motor torque, Lb.-Ft.

W=Looper motor speed, radians/sec.

$\dot{\theta}$=Looper table angle speed, radians/sec.

$\theta$=Looper table angles, radians $K_\theta$=Looper table angle demodulator gain, volts/radian $V_\theta$=Looper table angle demodulator output voltage, volts $V_T$=Looper motor TPS output voltage, volts $K_e$=Looper motor arm, current sensor gain, volts/ampere $V_c$=Looper motor arm, current output voltage, volts $K_v$=Looper motor TPS voltage sensor gain, volts/volt $K_{vg}$=TPS inner volt reg. controller static gain volts/-volt $V_g$=TPS gate input voltage signal volts $T_c$=Looper motor current controller rate time constant, sec.

$T_x$=Looper motor current controller integrator time constant, sec.

$K^*_c$=Static gain between current command limiter output voltage (curr. ref.) and input signal to current cont., volts/volt.

Figure 4:
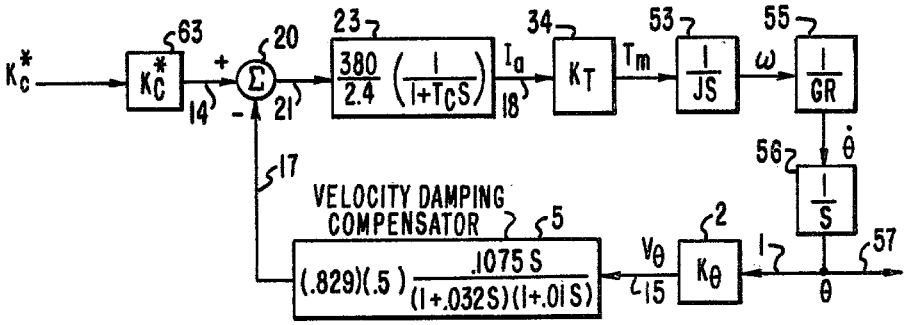
FIG. 4 is a simplified functional diagram of the current regulator within the circuit of FIG. 3.
Figure 5:
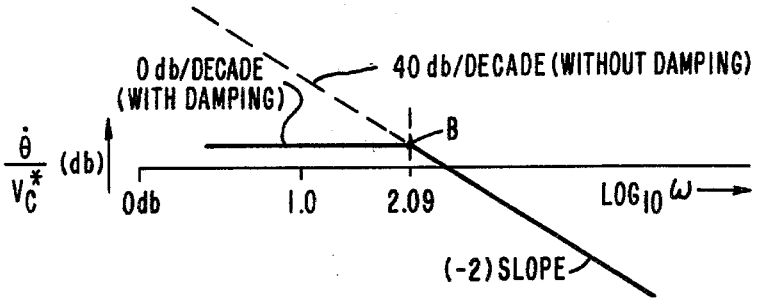
FIG. 5 is a closed-loop Bode plot of the looper motor armature regulator with, and without, the velocity damping feature of the present invention.

$V_{\theta X}$=Torque function generator output voltage signal, volts $V^*_C$=Current command limiter output voltage signal, volts $V^*_{CW}$=Looper unbalance weight current reference, volts $V^*_{CK}$=Initial looper kick current reference, volts $V^*_{CTG}$=Tension reference select current reference, volts FIG. 4 is a simplified representation of the regulating loop of the looper drive motor LDM and the associated velocity damping loop, for the purpose of illustrating by reference to FIG. 5 that velocity damping only reduces the gain of the looper regulator for the low frequencies.

Signal $V^*_C$ outputted by the current command limiter CCL goes into block 63 (like in FIG. 3), then to summer 20. From summer 20 via line 21 the signal goes to block 23 representing by a transfer function the conversion into armature current $I_a$. The transfer function typically is:

$$380/2.4 \times 1/(1+T_C S).$$

The armature current of line 18 is affected by block 34 introducing a coefficient $K_T$, thereby leading to torque $T_m$. Blocks 54 and 55 and integrator INT like in FIG. 3 concur in outputting the signal derivative $\mathring{\theta}$. Like in FIG. 3, the compensating loop includes line 1, table angle demodulator 2, velocity damper compensator 5 and line 17.

Conventional calculation of the transfer function by reference to FIG. 4 leads to:

$$\frac{\mathring{\theta}}{V_C^*} = K_C^* \left( \frac{6.45}{S^2} \right)$$

for the loop without velocity damping and to:

$$\frac{\mathring{\theta}}{V_C^*} = K_C^* \left( \frac{1.467}{.228\, S^2 + 1} \right)$$

with velocity damping.

FIG. 5 shows the Bode plot of the closed loop of FIG. 4, where $\mathring{\theta}$ is the looper table angle speed and $V^*_C$ the motor current regulator inputted reference. The decibels:

$$\mathring{\theta}/V^*_C$$

are plotted against the $\log_{10} \omega$ axis, or frequency axis. At point B (2.09 Rad/sec. or f=0.33 Herz) on the plot, the slope line breaks typically from 40 db/decade to zero db/decade, as a result of the velocity damping loop. In dotted line the plot is shown without damping, thus extending upward in the low frequency range.

Figure 6:
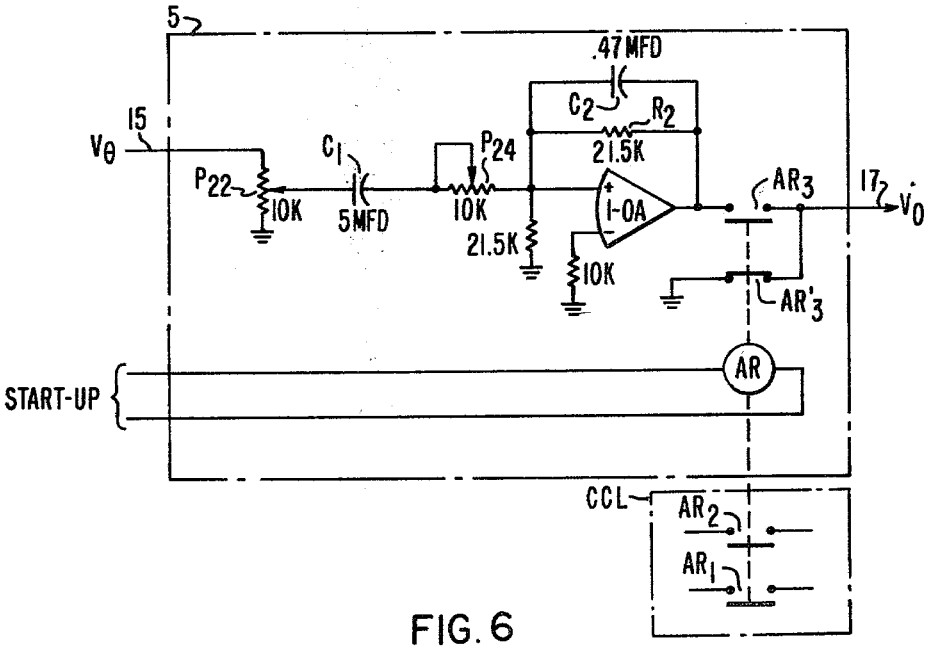
FIG. 6 typically shows a velocity damping compensator circuit that can be used in the current controller of FIG. 3.

FIG. 6 shows the velocity damping compensator illustratively shown as including an operational amplifier 1-0A mounted as a differential. The inputted signal $V_\theta$ of line 15 goes into a potentiometer $P_{22}$, then through a differentiating capacitor $C_1$, and a second potentiometer $P_{24}$ onto the inverting input of operational amplifier 1-0A. As usual, a capacitor $C_2$ and a resistor $R_2$ are mounted in parallel to form a feedback loop between the output and the input of the operational amplifier. Open contacts $AR_3$ are inserted in the output line 17 and closed contacts $AR'_3$ are provided as a short to ground in order to either allow, or prevent, compensation from line 17 to summer 20 of the current controller 22. Contacts $AR_3$ and $AR'_3$ are actuated together with contacts $AR_1$ and $AR_2$ of the current command limiter CCL when, at start-up, the start-up relay AR is actuated.

I claim:

1. In a rolling mill looper control system for controlling a looper arm supporting a looper roller adapted to engage a strip of material to be rolled from a first roll stand to a second roll stand, including a direct-current looper motor for applying torque to said looper arm; a speed regulator for adjusting the speed of at least one of said first and second roll stands to provide a predetermined extra-length of said strip between said first and second roll stands; and control circuit means associated with said direct current motor and responsive to a signal representative of instantaneous looper arm position for establishing a torque as a function of looper arm position, while applying said looper roller against said strip; the combination of:

means responsive to said instantaneous looper arm position representative signal for deriving a correction signal representative of looper arm position rate of change;

with said control circuit means being responsive to said correction signal, thereby to compensate for short term variations in said looper arm positioning.

2. The system of claim 1 with means operative on said control circuit means and responsive to a start-up condition for imparting to said looper arm a quick motion upward of the pass line of said strip between said first and second roll stands, thereby to make contact with said loop roller within a minimum time interval.

* * * * *